United States Patent [19]

Riedl

[11] Patent Number: 4,774,732

[45] Date of Patent: Oct. 4, 1988

[54] ADJUSTABLE BED

[76] Inventor: Georg Riedl, Hauptstrasse 10, D-3423 Andrä-Wördern, Austria

[21] Appl. No.: 20,372

[22] Filed: Mar. 2, 1987

[30] Foreign Application Priority Data

Feb. 28, 1986 [AT] Austria ..... 522/86

[51] Int. Cl.[4] ..... A61G 7/00

[52] U.S. Cl. ..... 5/66; 5/69; 5/77; 297/355

[58] Field of Search ..... 5/66–69, 5/74 R–77; 248/410; 297/90, 330, 355, 361

[56] References Cited

U.S. PATENT DOCUMENTS

| | | | |
|---|---|---|---|
| 3,877,088 | 4/1975 | Bowman | 5/66 |
| 3,974,530 | 8/1976 | Lusch et al. | 5/68 X |

FOREIGN PATENT DOCUMENTS

| | | | |
|---|---|---|---|
| 1256982 | 2/1961 | France | 5/68 |
| 152278 | 11/1955 | Sweden | 5/66 |
| 409463 | 5/1934 | United Kingdom | 5/69 |
| 1464573 | 2/1977 | United Kingdom | 5/66 |

*Primary Examiner*—Michael F. Trettel
*Attorney, Agent, or Firm*—Herbert Dubno

[57] ABSTRACT

A bed having a plurality of hingedly interconnected members of which the head and back support member is tiltable about an axis in the bed frame by balancing action. A brake comprising at least one pivotal board having a hole traversed by a linearly shiftable rod is coupled by a kinematic braking to the latter member to retain it in position.

4 Claims, 1 Drawing Sheet

ADJUSTABLE BED

FIELD OF THE INVENTION

My present invention relates to a bed and, more particularly, to an adjustable bed in which the lying surface comprises a plurality of hingedly interconnected members, at least the head and back support member is pivotally mounted in the bed frame to tilt about a horizontal axis in a balancing motion, and means is provided for retaining the latter member in a selected angular position about this axis.

BACKGROUND OF THE INVENTION

Adjustable beds of this type have the lying surface adjusted by a corresponding loading and unloading of the head and back support member, thereby utilizing the body of the recumbent individual for tilting this member about the aforementioned axis.

This member, because of the position of the tilting axis, thus can be angularly displaced about the axis by changing the weight distribution of the body of the recumbent person and each change in the balance can result in an angular displacement.

To prevent undesired tilting movements of the head and back support member, it is known to provide this member with a device for fixing the position thereof about the tilting axis.

The fixing device can be effected by a gas spring and a release of the retained position can be effected utilizing a bowden cable or the like, serving an actuating member.

Since relatively high pressures can prevail in such gas springs, they represent a source of danger and thus create a risk factor in the use of such beds.

Furthermore, gas springs are subject to a high degree of wear and have a comparatively short useful life so that relatively frequent replacement is necessary, since replacement, of course, is associated with high cost.

Swiss Patent No. 643,622 provides a bed-like article of furniture which has a plurality of hingedly interconnected parts which are positioned by a motor.

The motor drives a rod whose displacement effects an angular adjustment of the lying surface.

German Patent document-printed application DE-AS No. 1,174,463 provides a bed structure with movable head and foot members which can be raised and lowered via hydraulic cylinders.

It is also known to lock an angularly adjustable head member of a couch in place until a drop bolt with an opening through which a support rod of the head member can engage with play. The head member can thus be held in selected angular positions between two abutments.

OBJECTS OF THE INVENTION

It is the principal object of the present invention to provide an improved adjustable bed system which avoids drawbacks of the earlier arrangements described above and yet allows for comparatively simple balancing adjustment of the lying surface without complex structures such as gas springs, hydraulic cylinders or motors.

Another object of this invention is to provide an adjustable bed for the purposes described which can be constructed as far as possible exclusively of wood.

Yet another object of the present invention is to provide an improved, reliable and long-life structure for retaining an angularly adjustable bed part in position.

SUMMARY OF THE INVENTION

These objects and others which will become more readily apparent hereinafter are attained, in accordance with the present invention, in a bed which comprises a bed frame, means forming a lying surface having a head and back support member hingedly connected to a buttocks and upper leg support member, and lower leg support member. Means is provided for pivotally mounting the head and back support member between opposite ends thereof in the frame for tilting movement about an axis which will be referred to hereinafter as the tilting axis or as the balancing axis, since the position of the lying surface is adjustable by controlled distribution of the application of weight by the user about this axis.

According to the invention, a linkage is articulated to the head and back support member for connecting angular displacement of it into the linear displacement of a shifting rod or bar which, like the linkage, can be constructed of wood and which is movable on the frame rectilinearly to undergo the aforementioned linear displacement.

A brake on the frame engages the rod for releasably locking same against the linear displacement to retain the head and back support member in a preset position until the brake is released and the brake can be provided with actuating means which control its engagement with the rod.

The rectilinearly shiftable rod is disposed beneath the lying surface within the bed frame and takes up the weight applied to the lying surface by transforming it into the longitudinal compression, the brake holding the rod against longitudinal movement.

The actuating element can be a lever and/or a cable and can be constructed and arranged so as to release the brake, for example, the cable is pulled, i.e. placed under tension.

The rotational movement of the tiltable member is linearized by the linkage and transmitted to the rod.

The brake can be any construction which will lock the rod against displacement, for example, a stressable stop sleeve which can be pressed increasingly against the rod by parts which are brought into contact with the rod increasingly as they are screwed together.

In another brake construction, a pair of eccentrics can be provided diametrically across the rod and can be biased against the surfaces thereof. The longitudinal displacement of the rod can automatically engage the brake by causing a more firm contact of a brake shoe against the rod upon linear movement of the rod in one direction.

Particularly preferred, however, is a brake construction which utilizes at least one clamping member, preferably composed of wood, which is pivotal about one end and has a hole, through which the rod passes with clearance, a spring biasing the clamping member in a direction in which edges of the hole are brought into engagement with the rod. The angle of inclination of the rod can be altered by a cable so that this angle more closely approximates a right angle in which play is restored to release the brake.

When two such clamping members are provided, they both can have such bores and the clamping members can be pivotally mounted at opposite ends for displacement by respective springs in the same sense. The cable can couple both of the clamping members so as to pull the cables into position in which they more nearly approach right angles to the rod.

According to a further feature of the invention, the lever or cable actuator causes a time-controlled release of the brake. In the latter case, a control input which may be generated mechanically by a sandclock or the like can be used to effect timed release of the brake and thus a clamped transition of the bed from a sitting position, for example, into a recumbent position of the hingedly interconnected members (reading position to sleeping position).

BRIEF DESCRIPTION OF THE DRAWING

The above and other objects, features and advantages of the present invention will become more readily apparent from the following description, reference being made to the accompanying, highly diagrammatic drawing, in which.

SPECIFIC DESCRIPTION

Figure 1:
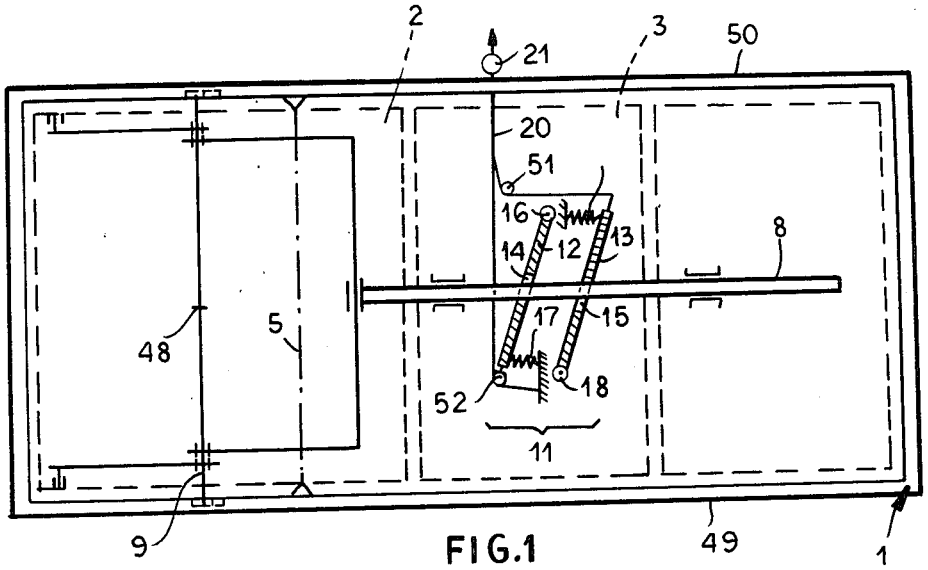
FIG. 1 is a diagrammatic plan view, partly broken away, of a bed according to the invention in which the lying surface has been shown in broken lines and the kinematic linkage only in single lines to better illustrate the functioning of the various parts of the bed.

Within the bed frame 1, I provide a lying surface which comprises three hingedly interconnected support members or segments 2,3,4. The head and back support member 2 can be tiltable about an axis 5 on the bed frame 1 and is connected by a hinge 40 to the buttocks and upper leg support member 3 the latter, in turn, is connected by a hinge 41 to the lower leg support member 4. The latter can also be connected by a pivot 42 to the bed frame if desired. The pivot 42 can be guided in a slot if required.

The angular displacement of the member 2 about the balancing axis 5 is controlled by the distribution of weight of the opposite sides of this axis.

The hinges 40 and 41 can have respective pintles guided in slots or channels in the longitudinal members 49,50 of the frame 1. These channels and slots have not been illustrated.

An inclination of the member 2 from the horizontal about the axis 5 in the embodiment illustrated causes a lowering in the seat-forming region and an upper end in the knee-support region of the surface. Other configurations of the lying surface are, however, possible.

So that the assumed position of the member 2 and the members hingedly connected therewith can be retained and two clamp transitions between different positions, a brake is provided beneath the three sections of the lying surface.

Figure 2:
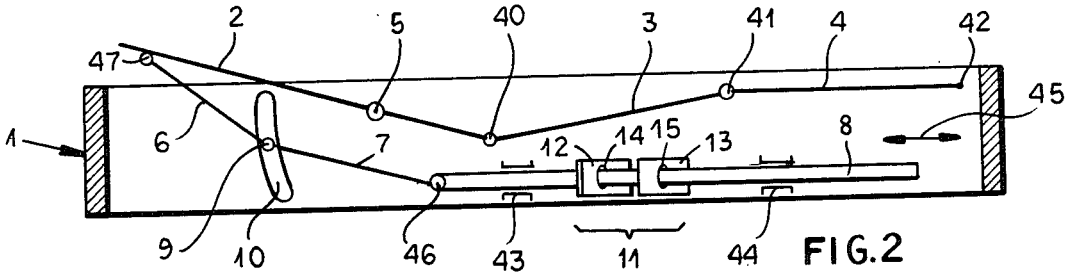
FIG. 2 is a vertical section through the bed, again with parts thereof shown only by single lines and in highly diagrammatic form to illustrate the kinematic action.

The kinematic connection between member 2 and a rectilinearly shiftable rod or bar 8 composed of wood 13 also visible from FIG. 2. Here the bar can be seen to be support for rectilinear movement horizontally in the longitudinal direction between supports 43,44 which are are only shown diagrammatically, but are connected to the frame. The rectilinear displacement of the bar 8 is represented by the double-headed arrow 45. The bar 8 is articulated at 46 to a bifurcated lever 7 forming one link of an articulated linkage whose other link 6 comprises a pair of members articulated at 47 to the upper end of member 2.

A hinge pin 48 connecting the links 6 and 7 has extremities 9 which are engaged in arcuate grooves 10 in the frame members 49 and 50.

The linkage 6,7,9, therefore, converts the angular displacement of member 2 into a linear displacement of the rod 8. A brake 11 engages this rod. As can be seen from FIGS. 1 and 2, the brake 11 can comprise two swingably mounted clamping members 12 and 13 which preferably are constituted from wooden boards.

The boards 12 and 13 are pivotally mounted at opposite ends 16 and 18 and are biased into inclined positions by springs 17 and 19 respectively, but in the same sense, about their respective pivots so that edges of holes 14 and 15 in the boards 12 and 13 through which the rod 8 passes will be engaged with opposite faces of the rod.

The holes 14 and 15 are larger than the cross section of the rod.

Under the spring action, therefore, sliding displacement of the rod is braked and the member 2 supported in its position until the brake is released. Release of the brake is effected by a bowden cable 20 which can be pulled by a knob 21 disposed at a side of the beds facilitating its engagement by the hand of a user. The cable 20, to this end passes through the longitudinal frame member 50.

The cable 20 passes around rollers 51 and 52, the roller 51 being mounted on the bed frame by means not shown while the roller 52 is mounted on board 12. When the cable 20 is pulled, therefore, the ends of the boards 12 and 13 which are engaged by the springs, thus are swung in the counter clockwise sense (FIG. 1) to approach right angles to the rod 8 and thereby free the rod to travel.

Figure 3:
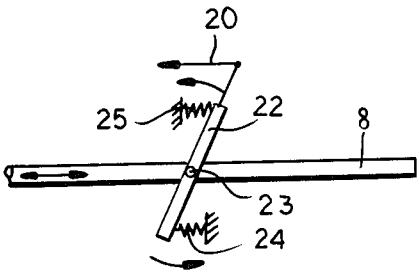
FIG. 3 is a diagrammatic elevational view illustrating a brake which can be used as a substitute for the brake shown in FIGS. 1 and 2.

FIG. 3 shows a variation on this brake utilizing only one clamping board 22, but which is hinged laterally of the rod 8 at 23 to the frame. Here the rod also passes through a hole (not shown) in the board 22 with play, while two springs 24 and 25 bias the board into an inclined position locking the rod 8 utilizing linear movement. When the cable 20 is pulled, the board 22 is swung in the counter clockwise sense to release the opposite edges of the hole from engagement with the opposite sides of the rod.

Figure 4:
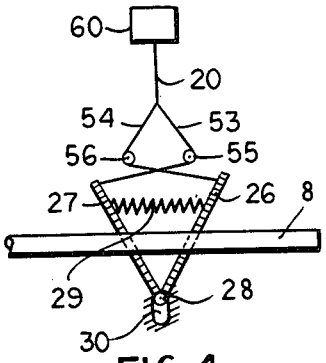
FIG. 4 is cross-sectional view through a brake which likewise can be used as a substitute for the brake of FIGS. 1 and 2.
Figure 5:
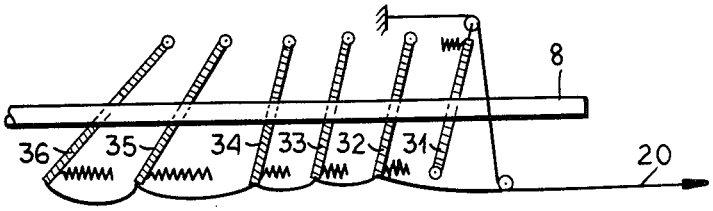
FIG. 5 is a diagram showing yet another brake according to the invention.

In FIG. 4, the clamping members with their respective holes are pivotally displaceable at 28 about a common pivot axis, which can move in a slot 30. A common spring 29 spreads the clamping members 26,27 in a V-pattern until the opposite edges of the holes grip the rod 8. The cable 20 here has strands 53 and 54 which pass about rollers 55 and 56 to engage the free ends of the clamping members 26,27 so that when the cable is pulled, these free ends are swung toward one another to release the rod 8. The slot 30 provides the play necessary to permit the opposite edges of the holes to engage the rod. In the embodiment of FIG. 5, clamping boards 31–36 are provided with respective springs and pivots and, if desired with different angles of attack on the rod.

The cable 20 not only swings the clamping boards in the same sense utilizing the principle described in connection with FIGS. 1 and 2, but it also is coupled to clamping boards 34,36 slackly so that these boards are actuated one after the other to release the rod 8 at time-spaced intervals.

In each of the brake systems described, a timing device; e.g. as shown at 60. Also can be provided, e.g. in the form of a sandclock or other mechanical timer to automatically cause release of the brake when it is desired, for example, to effect a transition between a sitting position and a recumbent or sleeping position.

The linkage formed by levers 6 and 7 can be realized also in the form of a pivotal plate and, if desired, the rod 8 can have annular grooves for better engagement of the brake boards therewith.

I claim:

1. A bed, comprising:

a bed frame;

means forming a lying surface having a head and back support member hingedly connected to a buttocks and upper leg support member, and a lower leg support member hingedly connected to said buttocks and upper leg support member;

means for pivotally mounting said head and back support member between opposite ends thereof in said frame for tilting movement about an axis;

a linkage articulated to said head and back support member for converting angular displacement of said head and back support member into a linear displacement;

a shifting rod mounted on said frame for rectilinear movement and articulated to said linkage for displacement corresponding to said linear displacement thereby;

a brake on said frame engaging said rod for releasably locking same against said linear displacement to retain said head and back support member in a preset position, said brake comprising:

two brake plates having holes traversed by said rod, pivot means for pivotally mounting said plates at opposite sides of said rod on said frame so that said plates assume mutually parallel braking positions engaging said rods, and respective springs bearing upon each of said plates at a side thereof opposite the respective pivot means for biasing said plates into said braking positions; and actuating means connected to said brake for controlling engagement of said brake with said rod, said actuating means including a respective cable acting upon each of said plates at the said side thereof opposite the respective pivot means and a common pull for said cables which, upon application of tension to said cables, causes said plates to swing in opposite senses about the respective pivot means to permit movement of said rod.

2. The bed defined in claim 1 wherein said plates are wooden boards and said rod is a wooden bar.

3. A bed, comprising:

a bed frame;

means forming a lying surface having a head and back support member hingedly connected to a buttocks and upper leg support member, and a lower leg support member hingedly connected to said buttocks and upper leg support member;

means for pivotally mounting said head and back support member between opposite ends thereof in said frame for tilting movement about an axis;

a linkage articulated to said head and back support member for converting angular displacement of said head and back support member into a linear displacement;

a shifting rod mounted on said frame for rectilinear movement and articulated to said linkage for displacement corresponding to said linear displacement thereby;

a brake on said frame engaging said rod for releasably locking same against said linear displacement to retain said head and back support member in a preset position, said brake comprising:

two brake plates having holes traversed by said rod, pivot means for pivotally mounting said plates at opposite sides of said rod on said frame so that said plates assume mutually parallel braking positions engaging said rods, a plurality of additional brake plates pivotally mounted on said frame by respective pivots at the same side of said rod as one of said pivot means, spaced apart along said rod, having holes traversed by said rod and engaging said rod in respective braking positions of said additional plates, and respective springs bearing upon each of said plates for biasing said plates into said braking positions; and actuating means connected to said brake for controlling engagement of said brake with said rod, said actuating means including at least one cable acting upon each of said plates at the said side thereof opposite the respective pivot which, upon application of tension to said cable, causes said plates to swing in opposite senses about the respective pivot means to permit movement of said rod.

4. The bed defined in claim 3 wherein said plates are wooden boards and said rod is a wooden bar.

* * * * *